United States Patent [19]

Bizinover et al.

[11] 4,034,682

[45] July 12, 1977

[54] MODULAR STRUCTURE FOR THE SUPPORT OF SHELVES AND SIMILAR ARRANGEMENTS

[76] Inventors: David Bizinover; Luis Feferbaum Gutfraind, both of Avenida Itaoca, 1863-1875, Rio de Janeiro, Guanabara, Brazil

[21] Appl. No.: 633,592

[22] Filed: Nov. 19, 1975

Related U.S. Application Data

[63] Continuation-in-part of Ser. No. 449,348, March 8, 1974, abandoned.

[51] Int. Cl.[2] ..... A47F 5/00

[52] U.S. Cl. ..... 108/107; 108/111; 108/114; 211/187

[58] Field of Search ..... 108/111, 114, 107–110, 108/102, 91; 211/187, 190

[56] References Cited

U.S. PATENT DOCUMENTS

| | | | |
|---|---|---|---|
| 624,637 | 5/1899 | Flashman | 108/114 |
| 2,249,142 | 7/1941 | Kagel | 108/111 |
| 2,529,649 | 11/1950 | Coplen | 108/114 |
| 3,045,834 | 7/1962 | Seiz | 211/177 |
| 3,059,780 | 10/1962 | D'Anka | 108/107 |
| 3,176,848 | 4/1965 | Stefan | 211/177 X |
| 3,233,942 | 2/1966 | Creutz | 297/440 |
| 3,648,627 | 3/1972 | Schliemann et al. | 108/111 |
| 3,908,564 | 9/1975 | Miller et al. | 108/111 |

*Primary Examiner*—Roy D. Frazier
*Assistant Examiner*—Darrell Marquette
*Attorney, Agent, or Firm*—Emory L. Groff, Jr.

[57] ABSTRACT

A modular shelving system assembly is constructed from a combination of tubular frame elements of a rectangular shape provided with a series of spaced aligned openings in opposed inner faces of both of the long side rails and the inner and outer faces of both of the short side rails are provided with a plurality of spaced aligned openings. The two side faces of at least one of the long side rails include aligned openings laterally spaced similarly to the openings in the short side rails. A plurality of identical frame elements may be connected to one another by means of appropriate fasteners fitted in related aligned openings with a short side rail connected to another short side rail to form a vertical column of frame elements. The opposite short side rails of additional similar frame elements are connected to adjacent long side rails of similarly constructed vertical columns to provide horizontal brace members and provide an integrated shelving unit. Shelf supporting rods are placed in appropriate opposed openings in the inner faces of the long side rails at desired intervals.

4 Claims, 6 Drawing Figures

MODULAR STRUCTURE FOR THE SUPPORT OF SHELVES AND SIMILAR ARRANGEMENTS

This application is a continuation-in-part of application Ser. No. 449,348, filed Mar. 8, 1974 now abandoned.

The invention relates to a modular element for use in constructing a shelving arrangement.

In known shelving systems, it is normally necessary to handle a number of component parts such as vertical posts, cross beams, brackets and related fastener elements in order to construct the shelving in the desired finished assembly. Such systems require considerable time to assemble and frequently require skills or aptitudes which many persons do not possess. Furthermore, they are limited in the variety of arrangements which can be made and often lack esthetic appeal.

The object of the present invention is to provide a simple and efficient means for constructing shelving which involves a single basic modular element which may be assembled with identical elements in a variety of ways quickly by the average individual without any special mechanical aptitude or skill.

Essentially, the invention comprises a rectangular frame element preferably made of square hollow tubing, although tubing of other cross sectional shapes may be used if desired. At least one of the long sides of the element is provided with spaced aligned openings through opposite side faces so as to receive fasteners such as nuts and bolts used to connect one element with another in a perpendicular manner. The short sides of the frame are also provided with spaced aligned openings in their inner and outer faces for the purpose of attachment to other frame elements in a longitudinal manner by means of fasteners. The outer faces of both of the long sides of the element are not provided with openings; however, the opposed inner faces of each of the long sides have spaced openings, preferably staggered relative to the referenced openings in the side faces of the one long side, and are adapted to receive removable shelf support members. The spacing between the openings in the side faces of the one long side of the modular element is identical to the spacing between the openings in the inner and outer surfaces of the short sides of the element so as to permit said elements to be turned side for side and end for end and be readily connected to each other to provide variable self-supporting shelving arrangements without the need for any additional dissimilar components.

The invention accordingly comprises the construction hereinafter described, the scope of the invention being indicated in the following claims.

A preferred embodiment of the invention is illustrated in the accompanying drawings wherein.

Similar reference characters indicate corresponding parts throughout the several views of the drawings.

Figure 1:
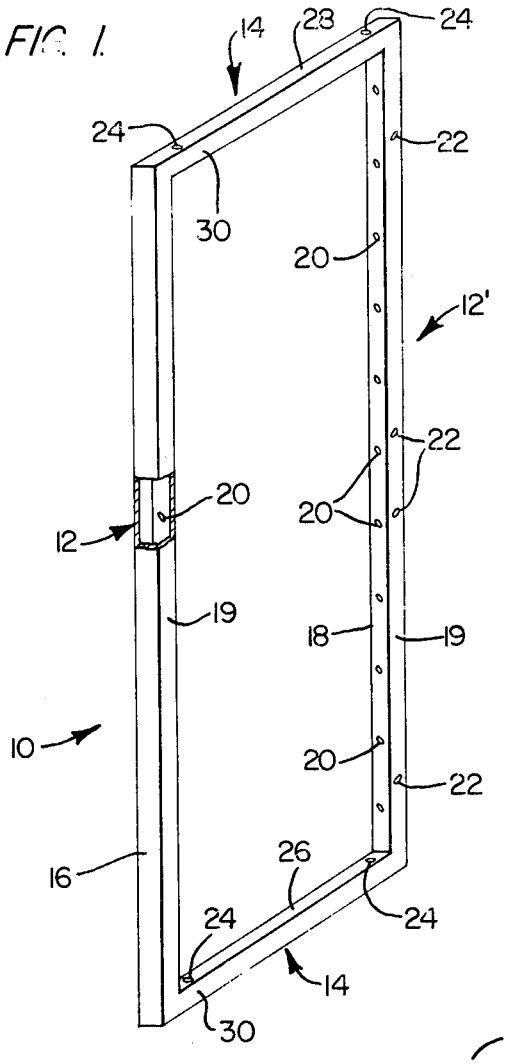
FIG. 1 is a perspective view of a modular element constructed in accordance with the invention.

Referring now to the drawings, particularly FIG. 1, the modular shelving element comprises a rectangular frame generally designated 10, including a pair of long side rails 12–12′ and a pair of short side or end rails 14—14 welded or otherwise connected to each other so as to make a rigid rectangular shelf construction element. The frame is preferably made of square tubing; however, it could be of other cross sectional shapes such as rectangular or circular. Each of the four side rails 12–12′ and 14—14 includes an inner face, outer face and a pair of side faces. The outer faces 16 of the long side rails 12 and 12′ are imperforate or plain, whereas the inner faces 18 of these long side rails are provided with oppositely aligned and preferably equispaced openings 20 throughout their length. Both side faces 19—19 of at least one of the long side rails 12′ are provided with aligned and specifically spaced openings 22 throughout their length, said openings being spaced or staggered between successive openings 20 in the adjacent inner face 18. The short side rails 14—14 are each provided with a plurality of aligned spaced openings 24 in each of their inner and outer faces 26 and 28 respectively, whereas the side faces 30 of rails 14 are imperforate or plain. The spacing between adjacent openings 22 is the same as the spacing between adjacent openings 24 such that the respective pairs of openings 20 and 24 can be aligned when the elements are assembled with the short side rails 14—14 connected to a pair of long side rails 12′—12′ as shown, for example, in FIG. 2. With the foregoing in mind it will be apparent that the length of each short rail should not exceed one-half the length of each long rail so that two separate frame elements 10 may be attached, by means of their short rails 14, to a single long rail 12′.

Figure 2:
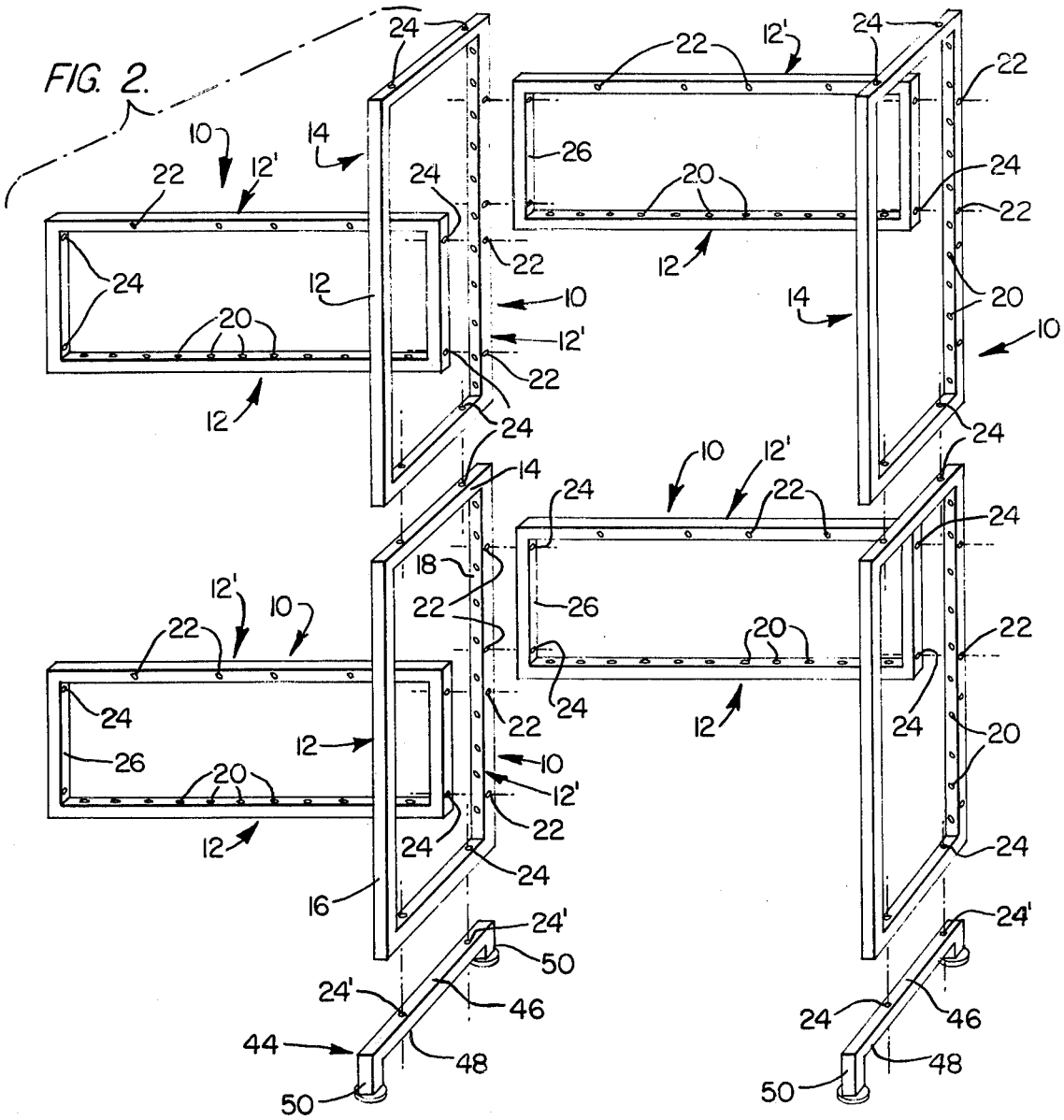
FIG. 2 is an exploded perspective view of shelving framework comprising a plurality of the elements illustrated in FIG. 1 in position to be connected to one another.
Figure 3:
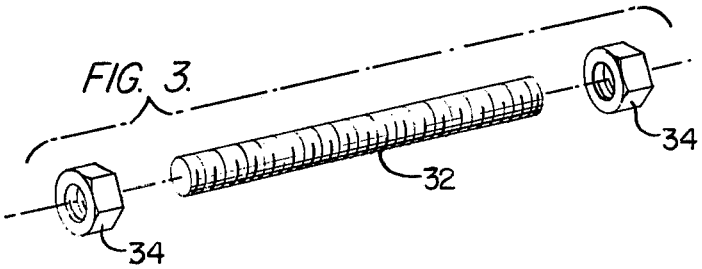
FIG. 3 is an enlarged exploded view of typical fastener elements used to connect one element to another.
Figure 4:
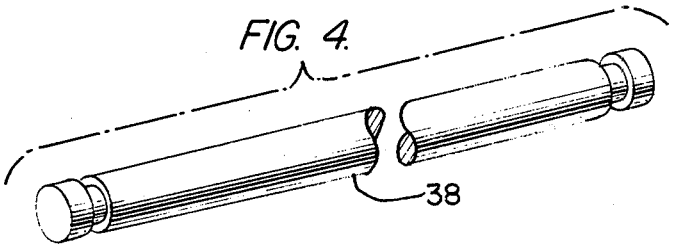
FIG. 4 is an enlarged perspective view, partly broken away, of a shelf supporting member.

When it is desired to assemble a shelving structure, a plurality of the frame elements 10 can be connected to each other through related openings in the inner and outer faces of the short side rails and the side faces of the long side rails by means of fasteners such as the bolt 32, threaded at both ends, and the nuts 34. A typical arrangement of connected frame elements is illustrated in FIG. 2 from which it can be seen that the elements 10 may be assembled with adjacent short side rails connected to each other by aligning the openings 24 to provide a vertical framework and the short side rails of other frames 10 connected to adjacent long side rails to serve as horizontal braces and connecting means for another column of vertically disposed frame elements. As previously mentioned, the outer faces 16 of the long side rails 12–12′ and the side faces 30—30 of the short side rails 14—14 are plain or imperforate and this is done primarily for esthetic reasons.

Figure 5:
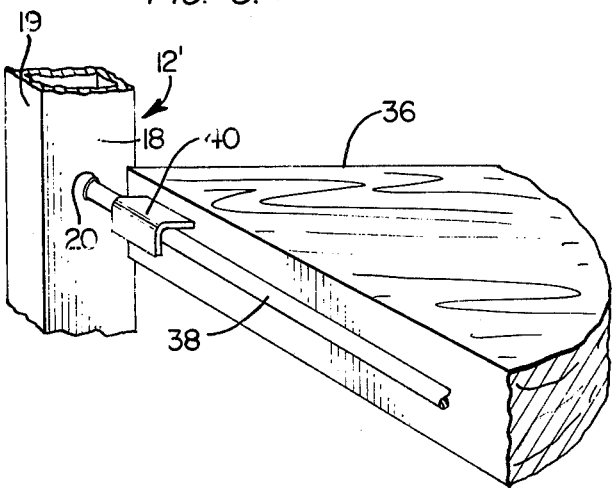
FIG. 5 is a fragmentary perspective view of a portion of one side of a modular element and a shelf supporting member with a portion of a shelf resting thereon.
Figure 6:
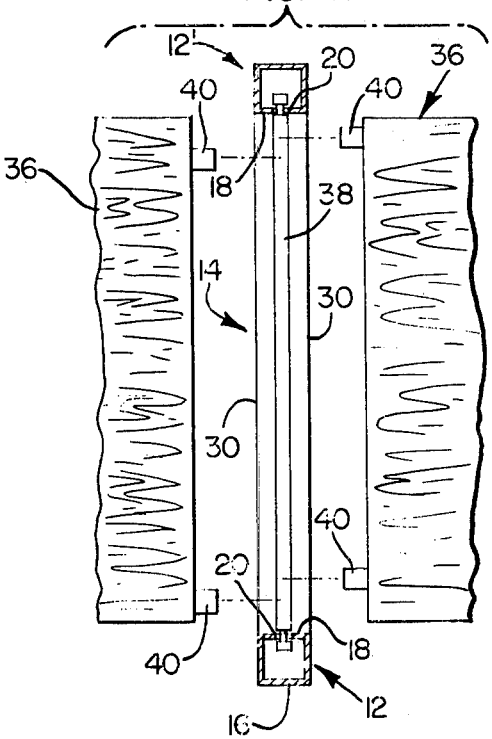
FIG. 6 is a top view, partly in section, of a pair of shelves in position to be placed on a shelf supporting member.

A shelf 36 may be attached to the supporting framework previously referred to by first placing a rod 38 in oppositely disposed openings 20 in the inner faces 18 of the long side rails 12 and 12′ and then placing the hanger or flange 40 of shelf 36 over the rod into the position shown in FIG. 5. By having a transversely offset disposition of the flanges 40 on the two ends of each shelf 36, two shelves can be mounted in the same horizontal plane and on the same rod 38 as indicated in FIG. 6.

It will be appreciated that a shelving assembly constructed in accordance with the invention is simple to erect and offers a variety of shelf spacing arrangements. Although it is not entirely necessary, it may be desirable to provide a base 44 for each column of vertically disposed frame elements 10. In such case, the upper 46 and lower 48 faces of the elongated portion of the base would be provided with spaced openings 24' for appropriate alignment with the related similarly spaced openings 24 in the short side rails 14 of the frame element to receive the bolts 32 therethrough. Legs 50 are provided at the lower ends of the elongated portion of the base.

The shelf supporting rod 38 could be a solid rod as shown, made of flexible material such as metal or plastic, and be of slightly greater length than the space between opposed inner faces 18—18 of the long side rails 12–12' so that it can be snapped into position in its related openings.

As previously described, the shelving arrangement can be simply and quickly assembled without the use of tools or at the most, with only a pair of pliers or a wrench to tighten the nuts 34 on bolts 32. If it is desired to move the shelving, it can be readily disassembled without any difficulty for storage or re-assembly in another location. Further, it is easy to add additional frame elements and shelves when desired to an assembled unit.

We claim:

1. A shelving assembly comprising, a framework including a plurality of rigid interconnected four-sided rectangular frame members of identical configuration, each said frame member including a pair of parallel long side rails and a pair of parallel short end rails connected to each other to define an integral rectangular member, all of said rails including inner faces, outer faces and side faces, the side faces of at least one said side rail each having spaced aligned openings therein, the inner and outer faces of said end rails each having spaced aligned openings therein, the inner faces of said side rails each having opposed spaced-apart aligned openings therein, the spacing between adjacent ones of said openings in said side faces of said side rail equal to the spacing between adjacent ones of said openings in said end rails, three of said frame members laterally spaced from each other each with their long side rails disposed vertically, a fourth and fifth of said same frame members each with their long side rails disposed horizontally and disposed respectively between the first and second and the second and third of said three laterally spaced vertically disposed frame members, said outer faces of said end rails of said fourth and fifth frame members juxtaposed the side faces of said laterally spaced three frame member side rails, fastener means connecting said fourth and fifth frame members to said spaced vertically disposed frame members through related aligned said openings in the end rails of said fourth and fifth frame members and said openings in the side faces of said spaced side rails, shelf support means connected to said opposed aligned openings in said inner faces of said side rails of said spaced vertically disposed frame members, shelves removably disposed between said first and second and between said second and third frame members, each said shelf including hanger means at each end engageable with said shelf support means, said hanger means at one end of each said shelf transversely offset relative said hanger means at the opposite end of each said shelf to permit two said shelves to each have one end engageable with a common one of said shelf support means and said openings in said inner faces of said side rails are spaced intermediate the location of said openings in the related side faces of said side rails to allow insertion of said shelf support means and said fastener means through a common one of said side rails without interference therebetween and without interference between said end rails of said fourth and fifth frame members connected to said second frame member side rail.

2. A shelving assembly according to claim 1 wherein said fastener means comprises a bolt threaded at each end and nuts threadedly engaged on the ends of said bolt.

3. A shelving assembly according to claim 1 wherein said shelf support means comprises a movable rigid rod.

4. A shelving assembly according to claim 1 wherein said end rails are no longer than one-half the length of said side rails.

* * * * *